US005820252A

United States Patent [19]

Finch

[11] Patent Number: 5,820,252

[45] Date of Patent: Oct. 13, 1998

[54] LIGHT FIXTURE HOUSING

[76] Inventor: David H. Finch, 3 Wolverton Rd., Asbury, N.J. 08802

[21] Appl. No.: 754,617

[22] Filed: Nov. 21, 1996

[51] Int. Cl.[6] ..... F21K 7/00

[52] U.S. Cl. ..... 362/265; 362/264; 362/294

[58] Field of Search ..... 362/226, 264, 362/265, 294, 373, 408

[56] References Cited

U.S. PATENT DOCUMENTS

| | | | |
|---|---|---|---|
| 3,364,348 | 1/1968 | Dameral | 240/51.11 |
| 4,275,433 | 6/1981 | Caldwell | 362/22 |
| 4,414,615 | 11/1983 | Szeker et al. | 362/264 |
| 4,700,279 | 10/1987 | Engel | 362/264 |
| 5,136,489 | 8/1992 | Cheng et al. | 362/294 |
| 5,136,490 | 8/1992 | Morrison | 362/294 |
| 5,140,225 | 8/1992 | Barton | 315/210 |
| 5,351,174 | 9/1994 | Ewing | 362/226 |
| 5,471,375 | 11/1995 | Lau | 363/260 |

*Primary Examiner*—Stephen F. Husar
*Attorney, Agent, or Firm*—Aquilino & Welsh

[57] ABSTRACT

A light fixture housing for fixtures generating substantial heat, wherein the fixtures include a lamp and socket connected to a core/coil energized by a capacitor and ignitor. The light fixture housing includes a housing including a first central compartment storing the core/coil, a second compartment storing the capacitor, and a third compartment storing the ignitor. A first internal wall separates and insulates the second compartment from the first central compartment and a second internal wall separates and insulates the third compartment from the first central compartment. The first internal wall includes a first opening permitting electrical connections between the capacitor and the core/coil to pass therethrough and the second internal wall includes a second opening permitting electrical connections between the ignitor and the core/coil to pass therethrough. The housing further includes a first mounting structure for supporting the lighting fixture housing and a second mounting structure for supporting the reflector below the light fixture housing. In use, the first central compartment, the second compartment, and the third compartment separate and insulate the capacitor and the ignitor from the core/coil to reduce the exposure of the capacitor and ignitor to the heat generated by the core/coil.

17 Claims, 4 Drawing Sheets

LIGHT FIXTURE HOUSING

BACKGROUND OF THE INVENTION

1. Field of the Invention

The invention relates to a light fixture. More particularly, the invention relates to a light fixture and a light fixture housing providing three compartments for protecting the capacitor and ignitor from the heat generated by the core/coil of the light fixture.

2. Description of the Prior Art

Mercury vapor, metal halide or high pressure sodium core/coils generate substantial heat when they are in use. These units generally include a light fixture housing for a capacitor, an ignitor, a transformer and a socket supporting a bulb. If hung from a ceiling, electrical leads extend through a conduit into the light fixture housing for connection to the ignitor and capacitor. These components connect to the core/coil, which is in turn electrically connected to the socket, which is generally located below the core/coil.

These units produce an abundance of useful light. However, the abundant light produced by the lamps and ballast result in a substantial heat build up. Specifically, heat is generated by the energized bulb and the core/coil. The build up of heat within and around the energized lamp and the core/coil creates excessive heat. The excessive heat may shorten the useful life of the fixture's components.

The development of heat within the ballast itself has been addressed by the provision of an annular space between the top of the ballast and the light fixture housing. The open annular space creates a chimney effect, allowing heat to rise upwardly and away from the ballast and socket. As a result, heat is not trapped within the ballast and the ballast is not exposed to excessive undesirable heat.

While the chimney effect created by the annular space between the top of the reflector and the light fixture housing alleviates the build up of undesirable heat within the ballast, the heat escaping from the ballast vents toward the light fixture housing and the components contained therein. The heat generated by the core/coil adds to the overall heat to which the light fixture is exposed. The heat generated by the core/coil, in combination with the heat venting from the lamp, are detrimental to the useful life of components stored within the light fixture housing, for example, the ignitor and/or the capacitor.

The dissipation of heat within such a light fixture is critical to the long term operation of the light fixture, as well as temperature ratings Underwriters' Laboratory applies to the light fixture. Specifically, in rating light fixtures for safe operation at a particular ambient temperature, Underwriters' Laboratory requires that all of the components of a light fixture dissipate heat sufficiently for the light fixture to be qualified for operation at a specified temperature.

While prior light fixtures have made progress in dissipating the heat generated by core/coils, a need continues to exist for a light fixture which efficiently dissipates heat to extend the useful life of the light fixture's components. The present invention provides such a light fixture.

SUMMARY OF THE INVENTION

It is, therefore, an object of the present invention to provide a light fixture housing for light fixtures generating substantial heat, wherein the light fixture includes a lamp socket connected to a core/coil energized by a capacitor and/or ignitor. The light fixture housing includes a housing having a first central compartment storing the core/coil, a second compartment storing the capacitor, and a third compartment storing the ignitor. A first internal wall separates and insulates the second compartment from the first central compartment and a second internal wall separates and insulates the third compartment from the first central compartment. The first internal wall includes a first opening permitting electrical connections between the capacitor and the core/coil to pass therethrough and the second internal wall includes a second opening permitting electrical connections between the ignitor and the core/coil to pass therethrough. The housing further includes a first mounting structure for supporting the lighting fixture and a second mounting structure for supporting the reflector below the light fixture housing. In use, the first central compartment, the second compartment, and the third compartment separate and insulate the capacitor and the ignitor from the core/coil to reduce the exposure of the capacitor and ignitor to the heat generated by the core/coil.

It is also an object of the present invention to provide a light fixture housing including cooling fins on an external surface of the housing.

It is a further object of the present invention to provide a light fixture housing wherein the cooling fins are located adjacent to the first central compartment.

It is also an object of the present invention to provide a light fixture housing wherein the housing is constructed from a first housing member and a second housing member which are selectively secured together to form the housing. The first housing member and the second housing member may be selectively separated to expose the first central compartment, the second compartment and the third compartment.

It is another object of the present invention to provide a light fixture housing wherein the first housing member includes a first central section, a second section and a third section and the second housing member includes a first central section, a second section and a third section. The first central section of the first housing member and the first central section of the second housing member define the first central compartment, the second section of the first housing member and the second section of the second housing member define the second compartment, and the third section of the first housing member and the third section of the second housing member define the third compartment.

It is also an object of the present invention to provide a light fixture housing wherein the first mounting structure includes a flange adapted to engage a top plate such that the top plate and the flange support the weight of the light fixture housing while the fixture is being wired.

It is a further object of the present invention to provide a light fixture housing wherein the second mounting structure includes at least one downwardly extending arm including means for engaging and supporting the reflector.

It is another object of the present invention to provide a light fixture housing wherein the first housing member and the second housing member are identical.

Other objects and advantages of the present invention will become apparent from the following detailed description when viewed in conjunction with the accompanying drawings, which set forth certain embodiments of the invention.

DESCRIPTION OF THE PREFERRED EMBODIMENT

The detailed embodiment of the present invention is disclosed herein. It should be understood, however, that the disclosed embodiment is merely exemplary of the invention, which may be embodied in various forms. Therefore, the details disclosed herein are not to be interpreted as limited, but merely as the basis for the claims and as a basis for teaching one skilled in the art how to make and/or use the invention.

Figure 1:
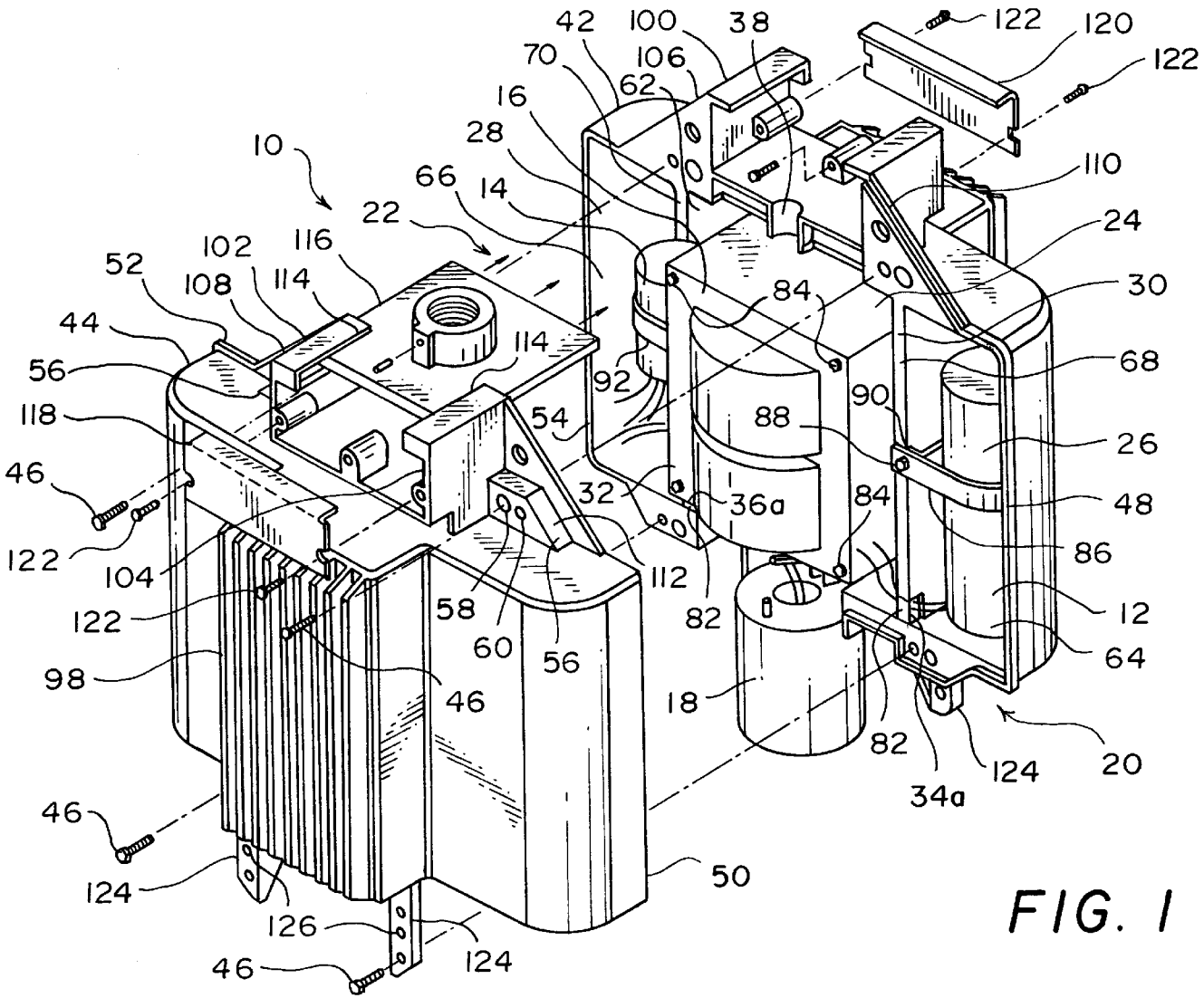
FIG. 1 is an exploded perspective view of the present light fixture.
Figure 4:
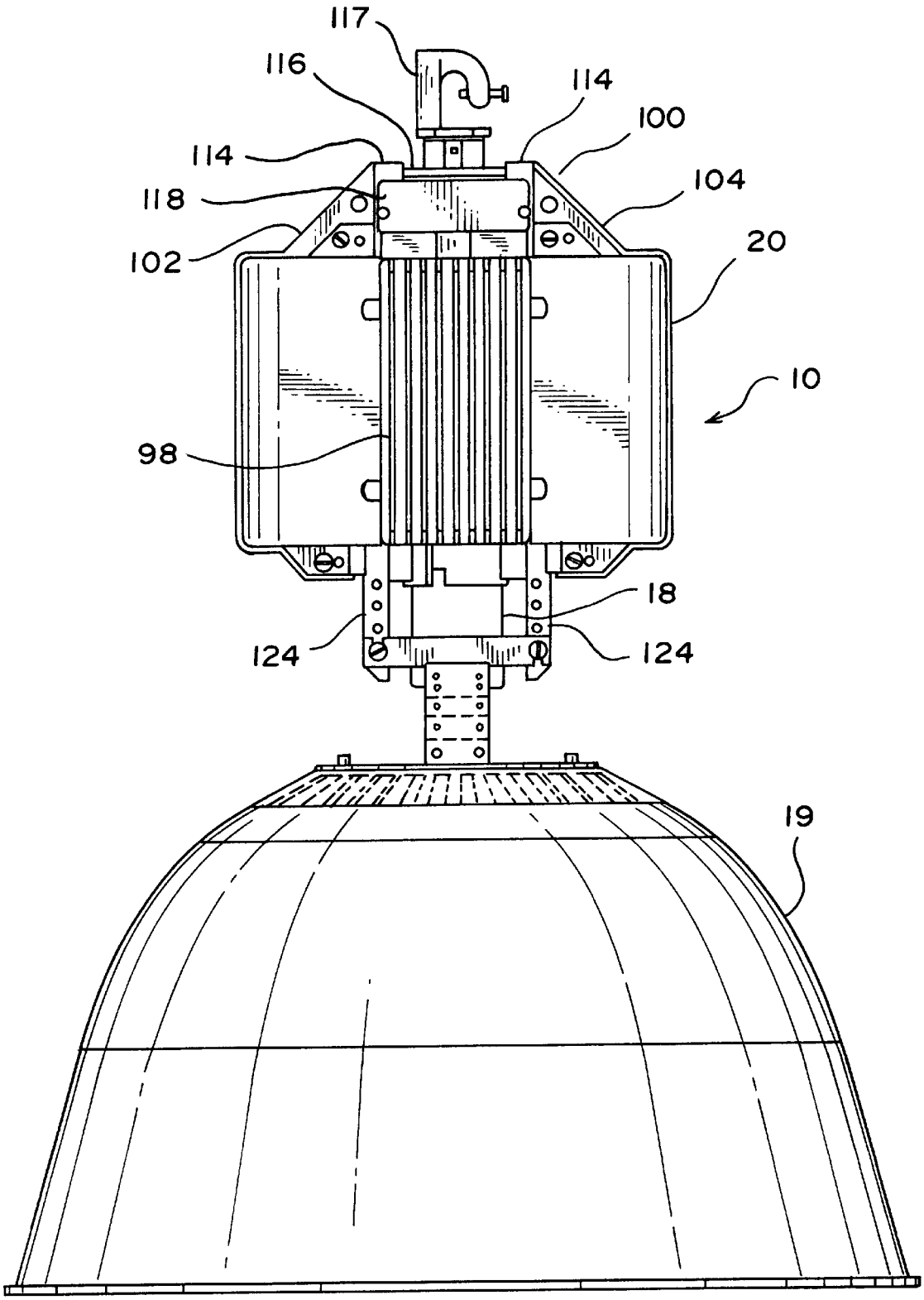
FIG. 4 is a perspective view of the present light fixture.

With reference to FIGS. 1 and 4, a mercury vapor, metal halide or high pressure sodium light fixture 10 is disclosed. As with prior light fixtures of this type, the light fixture 10 includes a capacitor 12, an ignitor 14, a core/coil 16 and a socket 18 for supporting a lamp 19. Briefly, when the light fixture 10 is hung from a ceiling, electrical leads extend through a conduit and into the light fixture housing 20 for connection to the ignitor 14 and capacitor 12. The ignitor 14 and the capacitor 12 are electrically coupled to the core/coil 16, which is in turn electrically connected to the socket 18 and lamp. The socket 18 and lamp are generally located below the core/coil 16.

The light fixture housing 20 of the present invention includes an internal cavity 22 in which the capacitor 12, ignitor 14 and core/coil 16 are stored. The cavity 22 includes a first central compartment 24 storing the core/coil 16, a second compartment 26 storing the capacitor 12, and a third compartment 28 storing the ignitor 14. The respective compartments are separated by internal walls which insulate and separate the fixture components from each other. Specifically, the walls are provided to respectively insulate the capacitor 12 and the ignitor 14 from the heat generated by the core/coil 16. A first internal wall 30 separates and insulates the second compartment 26 from the first central compartment 24 and a second internal wall 32 separates and insulates the third compartment 28 from the first central compartment 24.

Electrical connections between the first central compartment 24 and the adjacent second and third compartments 26, 28 are achieved by the provision of wire chase openings 34, 36 in the first internal wall 30 and the second internal wall 32. That is, the first internal wall 30 includes a first wire chase opening 34*a* and a second wire chase opening 34*b*, permitting electrical connections between the capacitor 12 and the core/coil 16 to pass therethrough. Similarly, the second internal wall 32 includes a first wire chase opening 36*a* and a second wire chase opening 36*b*, permitting electrical connections between the ignitor 14 and the core/coil 16 to pass therethrough.

In addition, the first central compartment 24 is provided with a wire chase opening 38 in the top of the light fixture housing 20. The wire chase opening 38 permits wiring to enter the light fixture housing 20. In addition, the first central compartment 24 is provided with a socket opening 40 in the bottom of the light fixture housing 20 in which the socket 18 leading to the lamp may be positioned.

The light fixture housing 20 is itself constructed from a first housing member 42 and a second housing member 44. The first housing member 42 and the second housing member 44 are identical and are merely joined together to form the complete light fixture housing 20. The first housing member 42 and the second housing member 44 are selectively coupled together by screws 46 positioned at locations about the housing. As a result, the light fixture housing 20 may be selectively opened to expose the first central compartment 24, the second compartment 26, and the third compartment 28.

As to the attachment of the first housing member 42 to the second housing member 44, the first housing member 42 is provided with an outer ridge 48 extending about the periphery of the first housing member 42 adjacent the second compartment 26. The outer ridge 48 is shaped and sized such that the outer edge 50 of the second housing member 44 adjacent the second compartment 26 fits within the outer ridge 48 of the first housing member 42. Similarly, the second housing member 44 is provided with an outer ridge 52 extending about the periphery of the second housing member 44 adjacent the third compartment 28. The outer ridge 52 is shaped and sized such that the outer edge 54 of the first housing member 42 adjacent the third compartment 28 fits within the outer ridge 52 of the second housing member 44. In this way, when the first housing member 42 and the second housing member 44 are assembled to form the complete light fixture housing 20, the outer ridges ensure proper alignment of the first and second housing members.

Both the first housing member 42 and the second housing member 44 are provided with two attachment members 56 through which screws 46 may be advanced to selectively couple the first housing member 42 to the second housing member 44. As shown in the preferred embodiment, the first housing member and second housing members are each provided with two attachment members 56. Each attachment member includes a pair of holes; a first hole 58 with threading to receive a screw therein and a second hole 60 with no threading such that a screw may readily pass therethrough. In fact, the threaded holes 58 on the first housing member 42 are aligned with the non-threaded holes 60 in the second housing member 44, and vice versa. In this way, it is possible to couple the first and second housing members together by applying screws thereto in a variety of manners, depending upon the orientation of the light fixture housing.

Figure 2:
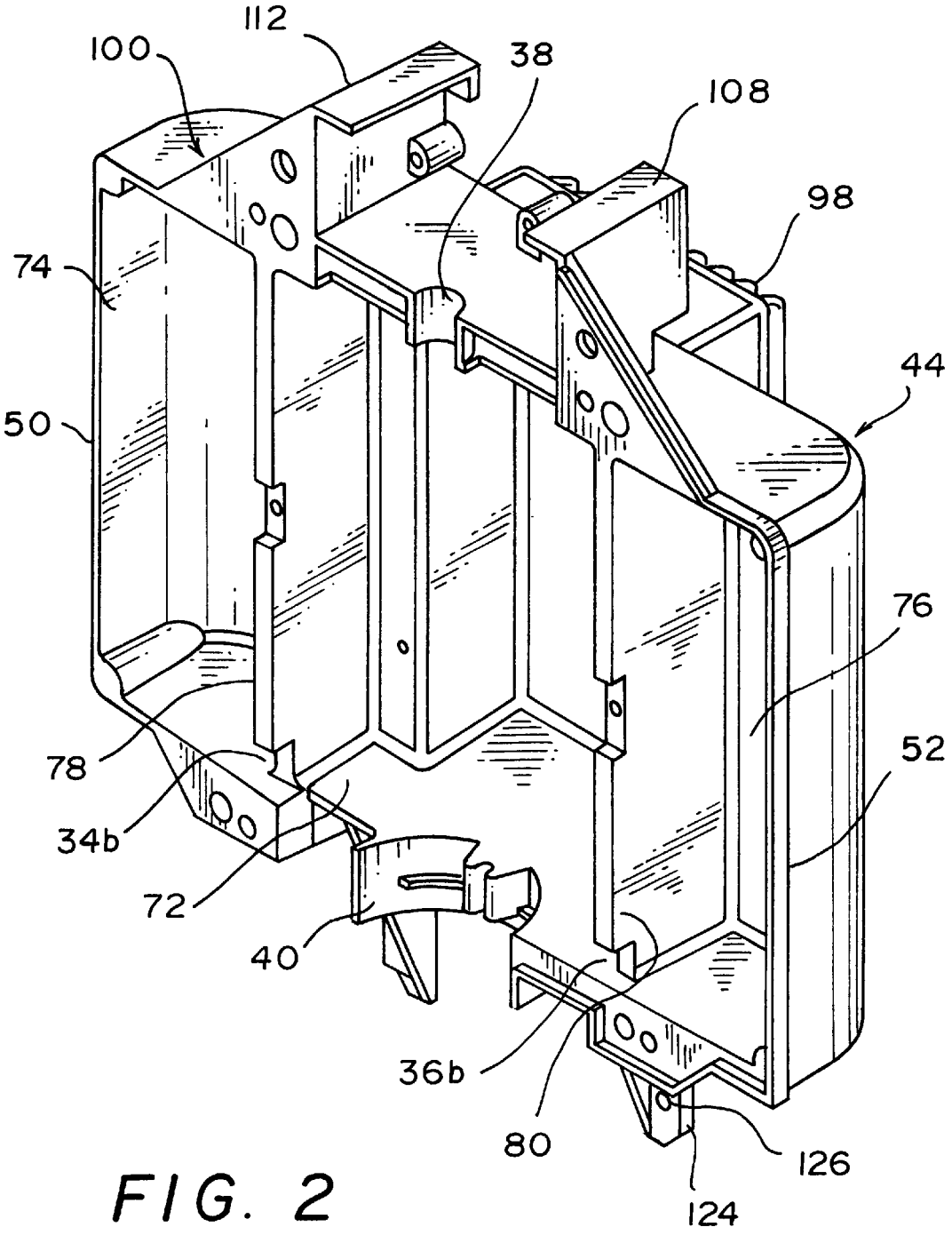
FIG. 2 is a perspective view showing the internal structure of the second housing member of the light fixture housing.
Figure 3:
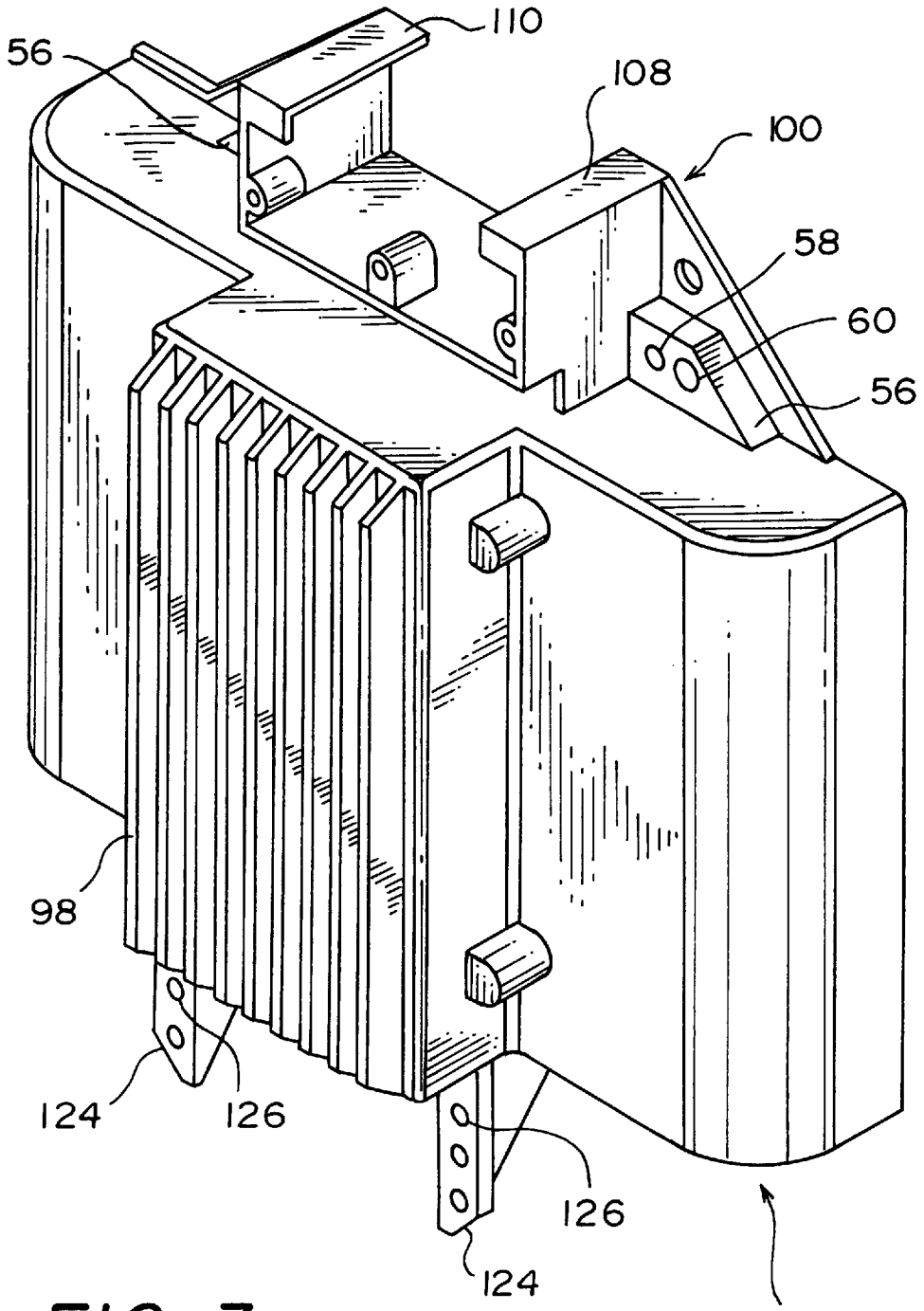
FIG. 3 is a perspective view showing the external structure of the first housing member of the light fixture housing.

With reference to FIGS. 1 and 2, the internal structures of the first housing member 42 and the second housing member 44 are shown in greater detail. The first housing member 42 includes a first central section 62, a second section 64 and a third section 66. A first wall member 68 separates the first central section 62 of the first housing member 42 from the second section 64 of the first housing member 42, while a second wall member 70 separates the first central section 62 of the first housing member 42 and the third section 66 of the first housing member 42. Similarly, the second housing member 44 includes a first central section 72, a second section 74 and a third section 76. A first wall member 78 separates the first central section 72 of the second housing member 44 from the second section 74 of the second housing member 44, while a second wall member 80 separates the first central section 72 of the second housing member 44 and the third section 76 of the second housing member 44. The first wall member 68 of the first housing member 42 is provided with the first wire chase opening 34*a* and a wire retainer clip 82 is positioned within the first wire chase opening 34*a*. Similarly, the second wall member 70 of the first housing member 42 is provided with the wire chase opening 36*a* and a wire retainer clip 82 is positioned within this wire chase opening 36*a*. The wall members of the second housing member 44 are provided with similar openings 34*b*, 36*b* and clips (not shown).

When the first and second housing members 42, 44 are secured together to form the light fixture housing, the first central sections of the first and second housing members align to form the first central compartment 24, the second sections of the first and second housing members align to form the second compartment 26, and the third sections of the first and second housing members align to form the third compartment 28. Similarly, the first wall members of the first and second housing members align to form the first internal wall 30 and the second wall members of the first and second housing members align to form the second internal wall 32.

The first compartment 24, second compartment 26 and third compartment 28 help to protect the capacitor 12 and the ignitor 14 from the heat generated by the core/coil 16 while the light fixture 10 is in use. In this way, the useful life of the fixture components is extended. The capacitor 12, ignitor 14 and core/coil 16 are securely retained within the light fixture housing 20 by a series of securing elements. Specifically, the core/coil 16 is secured with the first central compartment 24 by screws 84 which pass through the core/coil 16 and into screw holes formed in the walls of the first housing member 42. A first strap 86 securely retains the capacitor 12 within the second compartment 26. The first strap 86 passes around the capacitor 12 and is attached to the first wall member 68 of the first housing member 42 by a screw 88 which enters a screw hole formed in a notch 90 in the first wall member 68 of the first housing member 42. Similarly, a second strap 92 securely retains the ignitor 14 within the third compartment 28. The second strap 92 passes around the ignitor 14 and is attached to the second wall member 70 of the first housing member 42 by a screw (not shown) which enters a screw hole formed in a notch (not shown) in the second wall member 70 of the first housing member 42 (this attachment structure is identical to the structure provided for retaining the capacitor in position, which is discussed in detail above). Since the first and second housing members are identical, the second housing member 44 is provided with notches and screw holes similar to those found in the first housing member 42.

The dissipation of the heat produced by the core/coil 16 is further enhanced by the provision of cooling fins 98 on the outer surface of the light fixture housing 20. Specifically, both the first and second housing members are provided with cooling fins 98 on their outer surfaces. The cooling fins 98 are located adjacent to the first central sections of both the first housing member 42 and the second housing member 44. The cooling fins 98, therefore, transfer heat generated by the core/coil 16 to air passing by the outer surface of the light fixture housing 20, as opposed to detrimentally passing the heat to the adjacent ignitor 14 or capacitor 12.

Attachment of the light fixture housing 20 to a support structure is achieved by the provision of a first mounting structure 100. The first mounting structure 100 includes first and second flanges 102, 104 extending from the top of the light fixture housing 20. Since the light fixture housing 20 has a two piece construction, the first flange 102 is composed of a first flange member 106 formed on the first housing member 42 and a second flange member 108 formed on the second housing member 44 and the second flange 104 is composed of a third flange member 110 formed on the first housing member 42 and a fourth flange member 112 on the second housing member 44.

The first and second flanges 102, 104 each include a distal lip 114 with closed ends. The distal lips 114 of the first and second flanges 102, 104 are shaped to receive and hold a top plate 116 therewithin. When the light fixture 10 is fully assembled, the top plate 116 is assembled on a pipe stem 117. During assembly, the first and second flanges 102, 104 slip over the top plate 116 such that the light fixture housing 20 is supported while the light fixture 10 is being wired. Once the light fixture is properly wired, the wires are covered by first and second cover members 118, 120 selectively secured to the first and second flanges 102, 104 of the light fixture housing 20 by screws 122. The first and second cover members 118, 120 also act to secure the top plate 116 within respective distal lips of the first and second flanges 102, 104 so that the light fixture 10 is securely held by the support structure.

The light fixture housing 20 is also provided with four downwardly extending mounting arms 124. Each mounting arm 124 includes a series of holes 126 which may be used to attach the reflector to the light fixture housing through the provision of a mounting ring.

While the preferred embodiment has been shown and described, it will be understood that there is no intent to limit the invention by such disclosure, but rather, is intended to cover all modifications and alternate constructions falling within the spirit and scope of the invention as defined in the appended claims.

I claim:

1. A light fixture housing for a light fixture having a core/coils which generate substantial heat, wherein the light fixture includes a lamp and socket connected to a core/coil, which is energized by a capacitor and ignitor, comprising:

a housing including a first central compartment storing the core/coil, a second compartment storing the capacitor, and a third compartment storing the ignitor, wherein a first internal wall separates and insulates the second compartment from the first central compartment and a second internal wall separates and insulates the third compartment from the first central compartment;

the first internal wall includes a first opening permitting electrical connections between the capacitor and the core/coil to pass therethrough and the second internal wall includes a second opening permitting electrical connections between the ignitor and the core/coil to pass therethrough; and the housing further includes a first mounting structure for supporting the lighting fixture housing and a second mounting structure for supporting a reflector below the light fixture housing;

wherein the first central compartment, the second compartment and the third compartment separate and insulate the capacitor and the ignitor from the core/coil to reduce the exposure of the capacitor and ignitor to the heat generated by the core/coil when the fixture is in use.

2. The light fixture housing according to claim 1, wherein the housing includes cooling fins on an external surface of the housing.

3. The light fixture housing according to claim 2, wherein the cooling fins are located adjacent to the first central compartment.

4. The light fixture housing according to claim 1, wherein the housing is constructed from a first housing member and a second housing member which are selectively secured together to form the housing, and the first housing member and the second housing member may be selectively separated to expose the first central compartment, the second compartment, and the third compartment.

5. The light fixture housing according to claim 4, wherein the first housing member includes a first central section, a second section and a third section and the second housing member includes a first central section, a second section and a third section; and the first central section of the first housing member and the first central section of the second housing member define the first central compartment, the second section of the first housing member and the second section of the second housing member define the second compartment, and the third section of the first housing member and the third section of the second housing member define the third compartment.

6. The light fixture housing according to claim 1, wherein the first housing member and the second housing member are identical.

7. The light fixture housing according to claim 1, wherein the first mounting structure includes a flange adapted to engage a top plate such that the top plate and the flange support the weight of the light fixture housing while the light fixture is being wired.

8. The light fixture housing according to claim 1, wherein the second mounting structure includes at least one downwardly extending arm including means for engaging and supporting the reflector.

9. A light fixture, comprising:

a light fixture housing containing a capacitor, an ignitor and a core/coil, wherein the capacitor and ignitor are electrically coupled to the core/coil, and the core/coil is electrically coupled to a lamp and socket supported by the light fixture housing;

the light fixture housing includes:

a first central compartment storing the core/coil, a second compartment storing the capacitor, and a third compartment storing the ignitor, wherein a first internal wall separates and insulates the second compartment from the first central compartment and a second internal wall separates and insulates the third compartment from the first central compartment;

the first internal wall includes a first opening permitting electrical connections between the capacitor and the core/coil to pass therethrough and the second internal wall includes a second opening permitting electrical connections between the ignitor and the core/coil to pass therethrough;

wherein the first central compartment, the second compartment and the third compartment separate and insulate the capacitor and the ignitor from the core/coil to reduce the exposure of the capacitor and ignitor to the heat generated by the core/coil when the lamp is in use; and a first mounting structure secured to an upper end of the light fixture housing for supporting the light fixture housing as it extends from a support member.

10. The light fixture according to claim 9, wherein the light fixture housing includes cooling fins on an external surface of the housing.

11. The light fixture according to claim 10, wherein the cooling fins are located adjacent to the first central compartment.

12. The light fixture according to claim 9, wherein the light fixture housing is constructed from a first housing member and a second housing member which are selectively secured together to form the light fixture housing, and the first housing member and the second housing member may be selectively separated to expose the first central compartment, the second compartment and the third compartment.

13. The light fixture according to claim 12, wherein the first housing member includes a first central section, a second section and a third section and the second housing member includes a first central section, a second section and a third section; and the first central section of the first housing member and the first central section of the second housing member define the first central compartment, the second section of the first housing member and the second section of the second housing member define the second compartment, and the third section of the first housing member and the third section of the second housing member define the third compartment.

14. The light fixture according to claim 12, wherein the first housing member and the second housing member are identical.

15. The light fixture according to claim 9, wherein the first mounting structure includes a flange adapted to engage a top plate assembled on a pipe stem such that the top plate and the flange support the weight of the light fixture housing while the light fixture is being wired.

16. The light fixture according to claim 9, wherein the light fixture housing includes a second mounting structure for supporting a reflector.

17. The light fixture according to claim 16, wherein the second mounting structure includes at least one downwardly extending arm including means for engaging and supporting the reflector.

* * * * *